United States Patent [19]

Krauel, Jr.

[11] 4,245,136

[45] Jan. 13, 1981

[54] MONITOR AMPLIPHONES

[76] Inventor: Robert W. Krauel, Jr., 615 Traffic St., Bossier City, La. 71111

[21] Appl. No.: 951,015

[22] Filed: Oct. 12, 1978

[51] Int. Cl.[3] ..... H04S 3/00

[52] U.S. Cl. ..... 179/1 GQ; 179/1 MN; 179/1 R

[58] Field of Search ..... 179/1 GQ, 1 G, 1 MN, 179/156 R, 100.4 ST, 1 VL, 1 R, 175

[56] References Cited

U.S. PATENT DOCUMENTS

| | | | |
|---|---|---|---|
| 3,702,901 | 11/1972 | Cherry | 179/1 GQ |
| 3,710,034 | 1/1973 | Murry | 179/1 GQ |
| 3,794,779 | 2/1974 | Greuzerd et al. | 179/1 GQ |
| 3,796,840 | 3/1974 | Ohta | 179/1 GQ |
| 3,984,885 | 10/1976 | Yoshimura et al. | 179/156 R |

*Primary Examiner*—Douglas W. Olms
*Attorney, Agent, or Firm*—Hubbard, Thurman, Turner, Tucker & Glaser

[57] ABSTRACT

An improved quadraphonic headphone arrangement in which a first audio signal is coupled to a speaker in each headphone and a second audio signal, usually monaural, is coupled to an amplifier and then to a second speaker in each headphone. Switching means are also provided so that the second speakers may be connected directly to the second audio source without amplification. The headphone is used as a musician's practice aid or for track-making or similar purposes. A prerecorded signal is coupled to the first speakers while the musician's electronic instrument output is coupled through the amplifier to the second set of speakers.

13 Claims, 2 Drawing Figures

MONITOR AMPLIPHONES

BACKGROUND OF THE INVENTION

The present invention relates to an improved audio headphone, and more particularly to a headphone arrangement including amplification means in the signal path to one speaker in each of the headphones, and an improved method of using multi-speaker headphones.

Quadraphonic or four-channel headphones are well-known. References which show particular embodiments of such devices are U.S. Pat. No. 3,984,885, issued to Yoshimura, et al on Oct. 12, 1976 and U.S. Pat. No. 3,927,262, issued to Goeckel on Dec. 16, 1975. Generally speaking, such devices comprise an earpiece or headphone for each ear in which is contained at least two separate speakers. The purpose of such headphones is to reproduce quadraphonically recorded information such as music with the overall purpose being of more realistically recording and reproducing sound. The above-referenced patents and the references cited therein generally relate to improvements in such headphones which are intended to avoid the problem generally encountered in headphones in which the source of the sound appears to the listener to be in the center of his head.

Studio musicians are, of course, quite skilled in the art of quadraphonic sound recording and reproduction. Such musicians often use such equipment for listening to a pre-recorded track while simultaneously playing their own instrument as a practice aid. Of course, if a musician is using headphones which tend to block out the sound of his own instrument, he must typically feed the output of his instrument to an electronic mixing network which then electronically combines the recorded soundtrack with the output of his instrument and then couples the mixed output with sufficient power to his headphones so that he is able to compare the prerecorded signal with that which he is generating. Similar equipment is used in the process of overdubbing or re-recording in which a musician performs a particular musical composition a number of times with the same or different instruments with each performance recorded over that previously performed. It is, of course, necessary in such practice that the musician be able to listen simultaneously to the prerecorded track and to his presently performed music.

It can be seen that relatively expensive equipment has been required for such practice track-making, re-recording, etc., since typically studio quadraphonic or stereophonic mixing and amplification equipment has been used to provide the combined signals to the musician's headphones. It can also be seen that in the process of electronically mixing prerecorded presently produced sounds, the user of the headphones receives both signals and from precisely the same source, thus, reducing his ability to distinguish between the two.

Such typical studio practices would also be quite useful for home or classroom practice and teaching. But since the studio equipment is quite expensive, it is not practical for most musicians, especially students, to use the studio methods. The usual practice methods have involved simply playing a recorded selection through standard amplifiers and loud speakers while the musician plays his instrument through separate amplifiers and speakers. In a classroom situation, an instructor may be providing the original audio signal while the students play along trying to compare their performance to the instructor's. In either of these situations, the musicians have the problem, magnified by modern amplifiers, that their practice is a nuisance to others. In addition, if more than one musician tries to practice at the same time, each has trouble distinquishing his individual performance from the others. An instructor would likewise have trouble isolating a particular student's performance from the others.

Thus, it is seen that there is a need for an inexpensive practice aid which allows musicians to listen to two distinct audio signals at the same time for comparison purposes. In addition, the practice aid should isolate the audio signals from the surroundings and isolate the user of the aid from audio signals, other than the two desired signals.

SUMMARY OF THE INVENTION

Accordingly, an object of the invention is to provide an improved but inexpensive headphone arrangement which allows a listener to distinguish between separate signal sources.

Another object of the present invention is to provide a headphone arrangement with which a musician may simultaneously listen to a pre-recorded track and a presently produced original performance for comparison purposes.

Yet another object of the present invention is to provide a headphone arrangement with which a musician may simultaneously amplify and monitor his instrument's output while listening to another audio signal.

These and other objects of the present invention are achieved by providing a multi-channel headphone having means for coupling a first audio signal to first speaker means in each headphone and means for connecting the output of an instrument through an amplifier to second speaker means in each headphone.

BRIEF DESCRIPTION OF THE DRAWINGS

The present invention may be better understood by reading the following brief description of the preferred embodiments with reference to the accompanying drawings wherein.

DESCRIPTION OF THE PREFERRED EMBODIMENT

Figure 1:
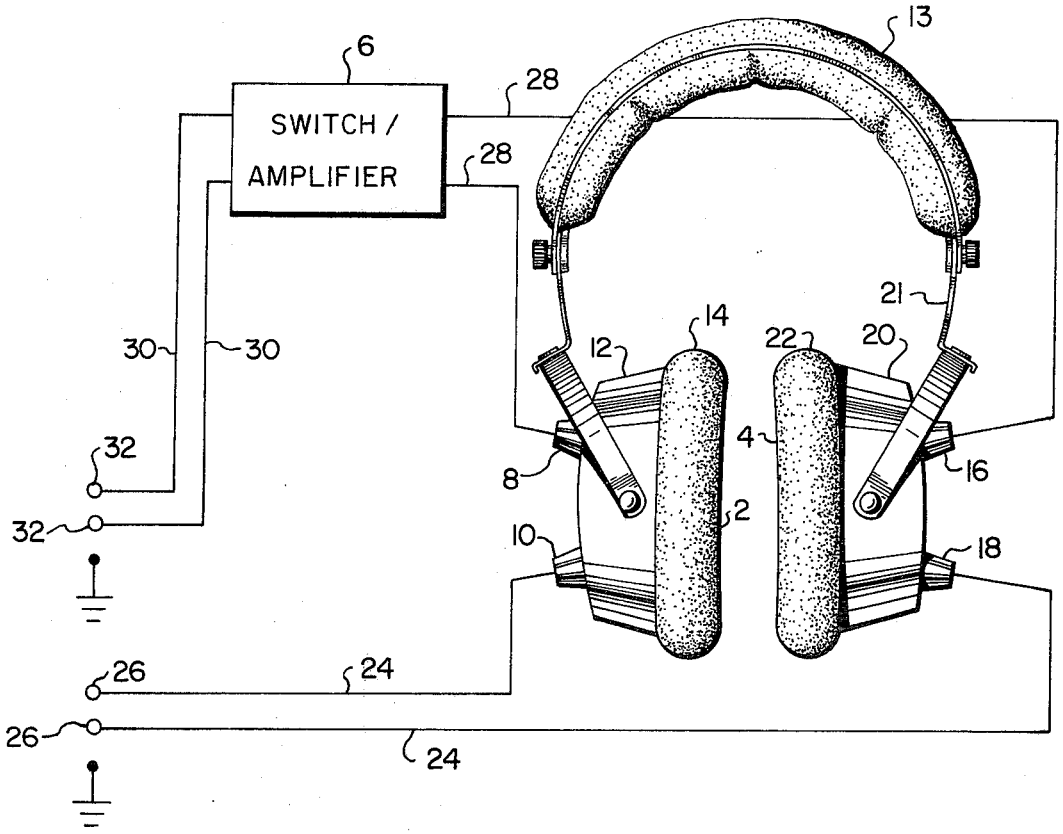
FIG. 1 is a block diagram of the amplifier headphone arrangement of the present invention and FIG. 2 is a schematic illustration of the amplifier and switching network of FIG. 1.

With reference now to FIG. 1, there is illustrated an improved four-channel headphone arrangement according to the present invention. This arrangement comprises headphones 2 and 4 and a network 6 containing switching arrangements and at least one amplifier. Headphone 2 comprises first and second speakers 8, 10, mounted in a housing 12 having a cushion 14 around its open edge for sealing to the head of a user. Headphone 4 is essentially identical, having first and second speakers 16 and 18 mounted in a housing 20 having a cushion 22 around its open edge. A pair of leads 24 are connected to speakers 10 and 18 and are adapted at their ends 26 for connection to a source for audio signals, such as a stereo amplifier. It is apparent that each of the leads 24 actually comprises two wires, that is a signal line and a ground return line, while only one is illustrated for simplicity.

The remaining two speakers 8 and 16 are connected by leads 28 to the output of a switching and amplifier box described in more detail with reference to FIG. 2. Inputs to box 6 are connected by leads 30 to a pair of input terminals 32 which are also adapted for connection to a source of audio signals such as a stereo amplifer, but preferably such as a musical instrument. It is apparent in this case also that leads 28 and 30 each comprise a pair of wires instead of a single wire illustrated for simplicity.

While amplifier and switch box 6 is shown as a separate component, it is preferably built in to either housing 12 or 20. This avoids the need for a separate housing, thus reducing the overall size, weight, and cost of the whole unit. In addition, it is quite annoying to have a small extra housing hanging in the middle of the connecting wires. The amplifier unit is preferably powered by a nine volt transistor radio battery. It is preferable to mount this battery in the housing 12 or 20 which does not contain the amplifier and switch. In a prototype unit, the battery was placed within a cushion 13 attached to a headband 21 which physically connects the headphones 2 and 4 together and holds them on the user's head.

It is also apparent that while wires 24 and 30 have been illustrated as the means for coupling two sets of signals to headphones 2 and 4, other means would also be suitable. It has now become practical to use low power FM transmitters and receivers to replace microphone or instrument cables. While these are now used principally for stage performances, they would also be adaptable for use with the headphones of the present invention.

While input 32 is described as adapted for connection to the electrical output of, for example, an electric guitar, a microphone output could also be used. Thus, musicians with non-electrical instruments may use a microphone to monitor their instruments and the amplifier in box 6 will provide sufficient power to drive speakers 8 and 16.

Figure 2:
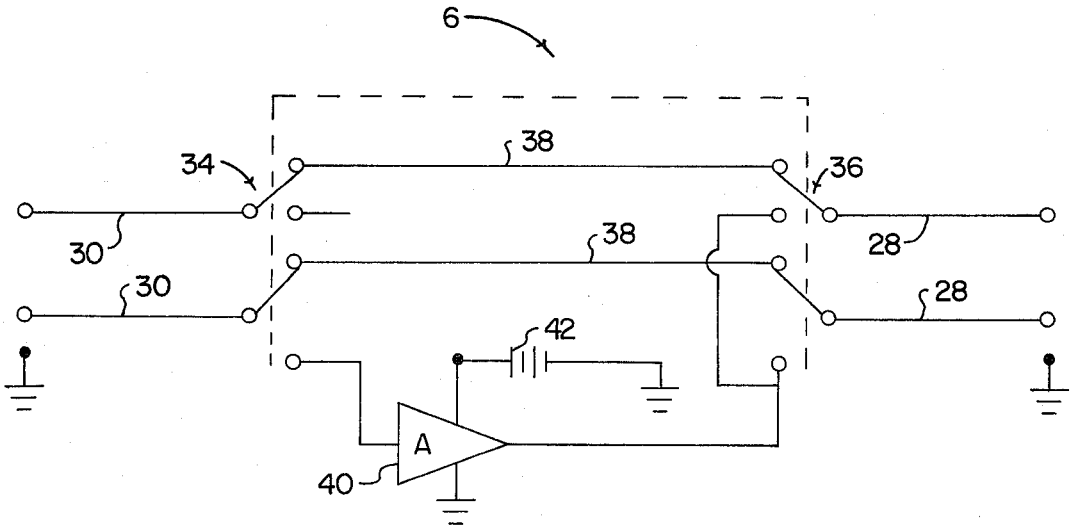

FIG. 2 illustrates one form of the switching and amplifier network 6 of FIG. 1. Input and output leads 30 and 28 are the same as those illustrated in FIG. 1. A first double-pole/double-throw switch 34 is connected to input leads 30 and a second similar switch 36 is connected to output leads 28. The switches 34 and 36 are linked together as shown so that they are all switched simultaneously. In the position illustrated in FIG. 2, the switches 34 and 36 make a direct connection between input 30 and output 28 by means of internal leads 38 within the switching box 6. In the alternate position of switches 34 and 36, one of the two input leads 30 is connected to the input of an amplifier 40 and the output of the amplifier is coupled to both of the output leads 28. With this arrangement, the signal appearing on only one of the leads 30 is amplified and coupled simultaneously to both of the outputs 28. While it is apparent that a second amplifier 40 could be provided for the second input 30, this is unnecessary in most practice, overdubbing, etc., applications. In general, the musician using the device is playing one instrument which has a single output and thus his performance is basically monaural. The arrangement of FIG. 2 amplifies this monaural output and couples it to each of the speakers 8 and 16 for comparison to signals received in speakers 10 and 18. Amplifier 40 is powered by a battery 42.

In the prototype, the switch 34, 36 also had a center position at which no contacts were closed. This arrangement provided an "off" position for speakers 8 and 16. Although not illustrated, it is apparent that various filters may be used as tone controls or compensation networks. For example, an input matching network might be desirable if a microphone is connected to inputs 32. Such filters are not used in the preferred form since the invention is intended as a monitor or practice aid and the headphone signals are not being permanently recorded. U.S. Pat. No. 4,087,631 issued to Yamada, et al on May 2, 1978, teaches various filter arrangements for improving headphone sound which could be used if desired.

In use, the apparatus of FIG. 1 has been found to provide a very natural feeling which allows the musician to accurately compare his performance to a prerecorded track or other reference. This is believed to be due to the fact that his performance, even though coupled through headphone speakers to his ears, is still electrically and spacially isolated from the pre-recorded or other audio signal. Thus, the user is able to distinguish his performance from a reference signal better than if the signals were electrically mixed as, for example, full quadraphonic sound with portions of each signal coupled to each of the speakers in both headphones. As a result, the user of the headphones is able to enjoy the privacy and other advantages of headphones without losing his ability to distinguish his performance from the reference signal. This result is accomplished with the use of equipment which is simple and inexpensive when compared to typical studio mixing and amplifying equipment.

The operation of the present invention can also be explained in terms of the natural human response to conventional stereophonic or quadrophonic performances. A quadrophonic performance is recorded as four channels which differ from each other only in the relative phases and amplitudes of the various components of the total performance. Assuming that the musicians are stationary during the recording, the phase and amplitude ratios of the channels remains constant. The normal human response to the four channels is to hear them as a single performance originating at a point in space determined by the phase and amplitude relations. In the preferred embodiment, the reference performance is a stereophonic performance having two related channels. The user responds to this performance as a single source having a single spatial location. The user's own independent performance is coupled through a separate and independent pair of speakers and is also sensed by the user as a single source having a spatial location different from that of the reference. There is no fixed amplitude and phase relation between the reference and practice performances, so that the user will not sense them as a single performance. The user is therefore able to clearly distinguish the practice performance from the reference.

It can be seen that a group of musicians can practice together using the present invention without interfering with each other. Thus, each one can listen to a reference performance on inputs 26 while listening to his own performance by inputs 32. In this way, neither the reference signal nor the practice performance need be amplified through loudspeakers. An instructor may use the arrangement to listen to one student's performance while comparing it to his own reference performance without interference from the rest of the class.

While the present invention has been described as having only two speakers in each earpiece, it is apparent that an additional speaker may be added to each earpiece. The basic four speaker arrangement allows the musician to monitor a reference sterophonic source while listening to his own performance as a monaural or even stereophonic signal. If it is desired to use a full quadraphonic source as a reference, then four speakers, two in each earpiece, are needed to listen to the reference work. An additional speaker in each earpiece would then be used to monitor the musicians live performance, again as either a monaural or stereophonic source. In this way, the electrical and spatial separations of the two signal sources are maintained with the same benefits as found in the preferred embodiment.

While the present invention has been described in terms of particular apparatus and methods used, it is apparent that various modifications and changes can be made within the scope of the present invention as defined by the appended claims.

I claim:

1. Headphone apparatus for comparing a reference performance to an independent performance of a musical work comprising:

right and left earpieces each comprising a generally cup-shaped casing adapted for covering the ears of a listener, first and second speaker means carried within each of said earpieces, coupling means connected to said first speaker means in each earpiece for coupling a first source of audio frequency signals representing said reference performance to said first speaker means, and electronic signal processing means, including amplifier means, having an input adapted for connection to a second source of audio frequency signals representing said independent performance and outputs connected to said second speaker means in each earpiece for coupling said second source to said second speaker means.

2. Headphone apparatus according to claim 1 wherein said coupling means is a plurality of electrical conductors adapted for connection to said first source of audio frequency signals.

3. Headphone apparatus according to claim 1 wherein said electronic signal processing means further includes switching means for, in a first switch position, coupling said second source directly to said second speaker means, and in a second switch position, coupling said second source to said amplifier means and the output of said amplifier means to said second speaker means.

4. Headphone apparatus according to claim 3 wherein said electronic signal processing means is mounted within one or both of said right and left earpieces and further including a plurality of electrical conductors connected to said input and adapted for connection to said second source of audio frequency signals.

5. Apparatus according to claim 4 wherein said electronic amplifier means further includes a battery.

6. Headphone apparatus according to claim 1 wherein said second speaker means comprises a single speaker in each earpiece.

7. Headphone apparatus according to claim 6 wherein said electronic amplifier means comprises a single electronic amplifier having an output connected to both speakers comprising said second speaker means.

8. Headphone apparatus according to claim 1 wherein said first speaker means comprises one speaker in each earpiece, said first source of audio frequency signals is a stereophonic source having outputs for providing a pair of stereophonic signals, and said coupling means is adapted to couple a separate one of the stereophonic signals to each speaker of said first speaker means.

9. A method of using multi-speaker headphones having at least two speakers in each earpiece for comparing a reference performance to an independent performance of a musical work comprising;

coupling first audio frequency signals representing said reference performance to a first speaker means in each earpiece of said headphones, and coupling a second audio frequency signal representing said independent performance to second speaker means in each earpiece, whereby a user of said headphones is able to compare said reference and independent performances.

10. A method according to claim 9 wherein said second audio signal is coupled through an amplifier to said second speaker means.

11. An improved method according to claim 9 wherein said reference performance is a prerecorded performance.

12. An improved method according to claim 9 wherein said first speaker means comprises a single speaker in each headphone and said first audio signals comprise a pair of stereophonic signals.

13. A method according to claim 9 wherein said second audio frequency signal is the output of a musical instrument.

* * * * *

UNITED STATES PATENT AND TRADEMARK OFFICE

CERTIFICATE OF CORRECTION

PATENT NO. : 4,245,136

DATED : January 13, 1981

INVENTOR(S) : Robert W. Krauel, Jr.

It is certified that error appears in the above-identified patent and that said Letters Patent are hereby corrected as shown below:

Column 1, line 54, after "prerecorded" insert --and--

Column 1, line 56, delete "and"

Signed and Sealed this

*Fourteenth* Day of *April 1981*

[SEAL]

*Attest:*

RENE D. TEGTMEYER

*Attesting Officer*

*Acting Commissioner of Patents and Trademarks*